United States Patent [19]

Hodosh et al.

[11] Patent Number: 5,058,230

[45] Date of Patent: Oct. 22, 1991

[54] TOOTHBRUSH WITH REPLACEABLE TIP PORTION

[76] Inventors: Milton Hodosh; Alex J. Hodosh; Steven H. Hodosh, all of 243 Elmwood Ave., Providence, R.I. 02907

[21] Appl. No.: 532,732

[22] Filed: Jun. 4, 1990

[51] Int. Cl.[5] ..... A46B 7/04

[52] U.S. Cl. ..... 15/167.1; 15/176.1; 15/22.1

[58] Field of Search ..... 15/167.1, 167.2, 176.1, 15/110, 22.1

[56] References Cited

U.S. PATENT DOCUMENTS

| | | | |
|---|---|---|---|
| 1,758,632 | 5/1930 | Wagner . | |
| 1,887,913 | 11/1932 | Bell | 15/167.1 |
| 2,175,278 | 10/1939 | Orebaugh | 15/176.1 |
| 2,287,327 | 6/1942 | Rickenbacher . | |
| 2,362,159 | 11/1944 | Rickenbacher . | |
| 2,503,134 | 4/1950 | Schroeder . | |
| 2,668,973 | 2/1954 | Glaza et al. . | |
| 2,875,458 | 3/1959 | Tsuda | 15/176.1 |
| 3,369,265 | 2/1968 | Halberstadt et al. | 15/176.1 |
| 4,020,521 | 5/1977 | Velasquez . | |

*Primary Examiner*—Harvey C. Hornsby
*Assistant Examiner*—Patrick F. Brinson
*Attorney, Agent, or Firm*—Salter & Michaelson

[57] ABSTRACT

A toothbrush includes an elongated handle portion and a tip portion detachably received on the handle portion. One of either the handle portion or the tip portions has a longitudinally extending cavity formed in one end thereof and the other of either the tip portion or the handle portion has a projection formed on one end thereof which is receivable in the cavity for detachably securing the tip portion on the handle portion. The tip portion preferably includes a base having bristles thereon for brushing the teeth of a user.

11 Claims, 2 Drawing Sheets

TOOTHBRUSH WITH REPLACEABLE TIP PORTION

BACKGROUND AND SUMMARY OF THE INVENTION

The instant invention relates to dental care products and more particularly to a toothbrush with a replaceable brush portion.

The need for effective and regular dental care to prevent tooth decay and/or periodontal disease is well recognized. It is also recognized that in order to be effective a program of dental care should include a daily regimen of brushing, gum massaging, and flossing. Still further, it is recognized that in order to be effective a regimen of daily brushing must be carried out with an effective and proper toothbrush having bristles which are not excessively worn or frayed. In this connection, it has been found that the bristles of even a high quality toothbrush can become worn or frayed after several weeks of normal use and that therefore even a high quality toothbrush should be replaced after approximately one month's use. It has also been found that a toothbrush should be replaced whenever the user thereof has had any type of illness in order to avoid infecting the user's gums during subsequent brushing.

Despite the proven advantages of frequently replacing toothbrushes it has been found that for various reasons, such as convenience and cost, users have often failed to replace their toothbrushes with sufficient frequency. It has been further found that, as a result, many persons have failed to gain the benefits from regularly brushing their teeth which might be realized if at least the brush portions of their toothbrushes were replaced more frequently.

While the general concept of providing toothbrush having a replaceable brush portion has been previously known, the previous attempts to construct toothbrushes of this type have generally been commercially unsuccessful for various practical reasons. In other words, while it has generally been recognized that the basic concept of providing a toothbrush having a replaceable brush portion has merit, the previously available toothbrushes having removable brush portions have failed to provide an adequate and practical solution to the problem of providing a toothbrush having an effective, simple, and readily replaceable brush portion. In this regard, toothbrushes representing the closest prior art to the subject invention of which the applicant is aware are disclosed in the U.S. patents to Wagner U.S. Pat. No. 1,758,632; Rickenbacher U.S. Pat. No. 2,287,327; Rickenbacher U.S. Pat. No. 2,362,159; Schroeder U.S. Pat. No. 2,503,134; Glaza et al U.S. Pat. No. 2,668,973; and Velazquez U.S. Pat. No. 4,020,521. However, since these references fail to suggest a toothbrush having a detachable brush portion which is adapted to be secured to a handle portion in the manner of the toothbrush of the instant invention, they are believed to be of only general interest with respect thereto.

The instant invention provides an effective and practical toothbrush construction comprising a handle portion and a tip or brush portion which is detachably secured to the handle portion. More specifically, the instant invention provides a toothbrush comprising a handle portion and a detachable tip portion which is operative for brushing the teeth or massaging the gums of a user in a conventional manner, but which is adapted to permit the tip portion to be simply and easily replaced, as needed. Still more specifically, the toothbrush of the instant invention comprises an elongated handle portion having a brushing end and a tip portion which is detachably received on the brushing end of the handle portion. The handle portion has a cavity of non-circular cross section formed therein which extends longitudinally inwardly from the brushing end. The tip portion includes a base having a dental instrument thereon, the instrument preferably comprising brush means for brushing the teeth of a user, and a projection which extends outwardly from one end of the base. The projection on the tip portion is of non-circular cross section and it is adapted to be snugly received in the cavity, and means is provided for releasably retaining the projection in the cavity in order to retain the tip portion on the brushing end of the handle portion. The cavity and the projection are preferably both of substantially rectangular cross section and the retaining means preferably comprises detent means which is operative for releasably retaining the projection in engagement in the cavity. The tip portion preferably has a recessed channel formed therein which extends around the perimeter of the projection thereon, and the handle portion preferably has a rim which extends longitudinally outwardly from the brushing end of the handle portion around the perimeter of the cavity. The rim on the handle portion is preferably of substantially the same dimension and configuration as the recessed channel in the tip portion and the rim is releasably receivable in engagement in the recessed channel to effect a seal between the handle portion and the tip portion around the projection. Further, the rim on the handle portion is preferably recessed inwardly from the outer surface of the handle portion, and the rim and the recessed channel are preferably both of substantially rectangular configuration.

It has been found that the toothbrush of the instant invention can be effectively utilized for brushing the teeth of a user. In this connection, because of the manner in which the tip portion is detachably secured to the handle portion, the tip portion is firmly and positively retained on the handle portion during a brushing operation. Further, because the handle portion includes a rim which is receivable in the channel in the brush portion for effecting a seal between the handle portion and the tip portion, the toothbrush of the instant invention is constructed so as to minimize the areas thereon where bacteria could potentially grow when the toothbrush is not in use. Still further, because the tip portion is readily and easily detachable from the handle portion, the tip portion can be quickly and easily replaced with either a new tip portion or with a tip portion of a different type, such as a rubber massaging tip, a small post-surgical brush, or an interproximal brush.

Accordingly, it is a primary object of the instant invention to provide an effective toothbrush comprising a handle portion and a tip portion, which is adapted to be firmly and positively detachably retained on the handle portion.

Another object of the instant invention is to provide a toothbrush comprising a handle portion having a longitudinally extending cavity in one end thereof, and a tip portion having a projection thereon which is receivable in the cavity in the handle portion for securing the brush portion to the handle portion.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
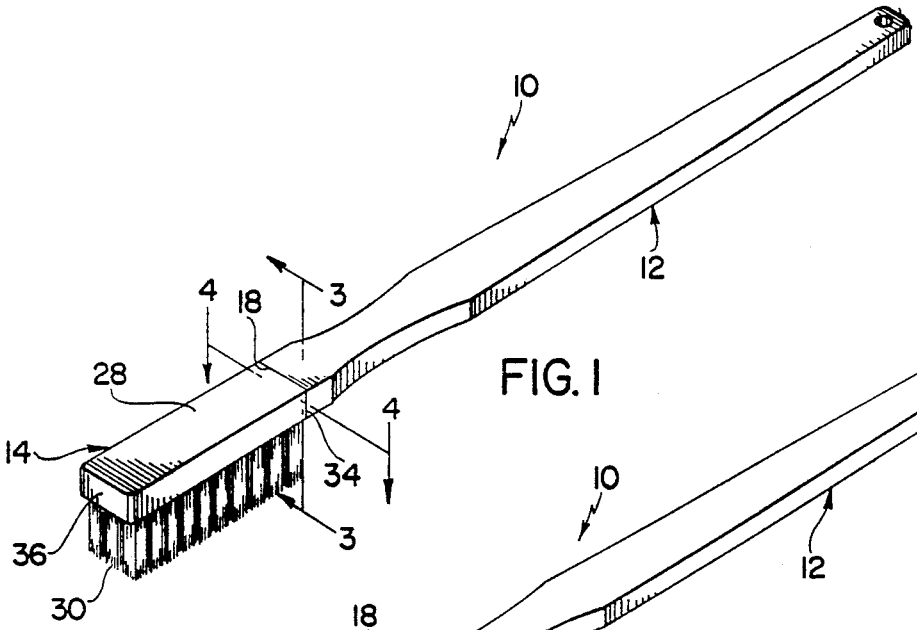
FIG. 1 is a perspective view of the toothbrush of the instant invention.
Figure 2:
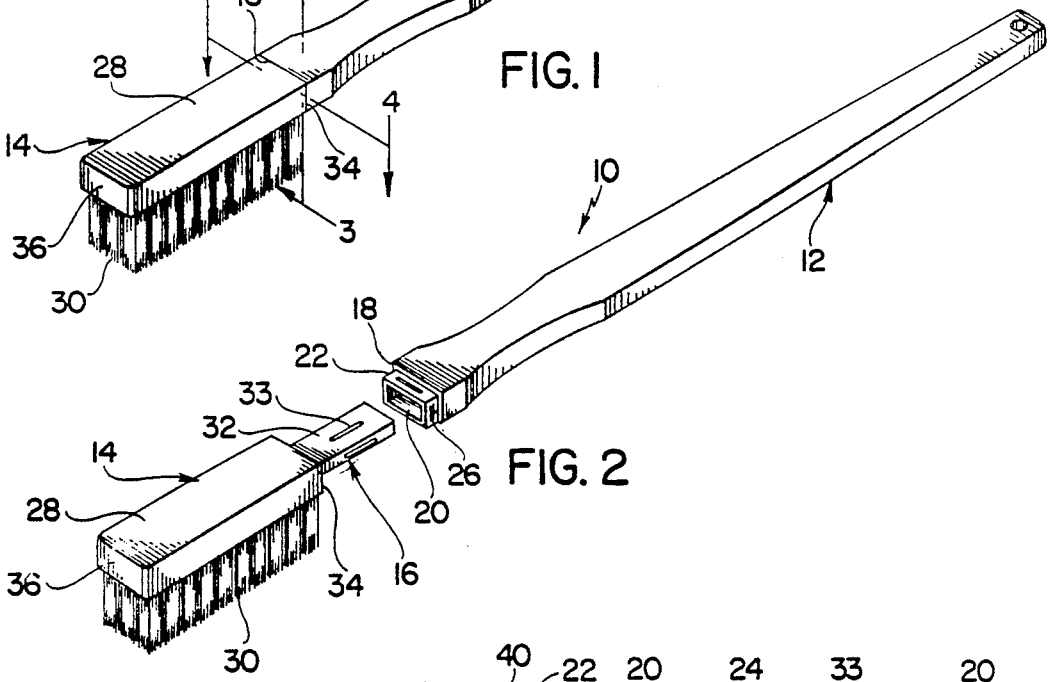
FIG. 2 is an exploded perspective view thereof.

Referring now to the drawings, a first embodiment of the toothbrush of the instant invention is illustrated in FIGS. 1 through 4 and generally indicated at 10 in FIGS. 1 and 2. The toothbrush 10 comprises a handle portion generally indicated at 12, a tip portion generally indicated at 14, and a detent assembly generally indicated at 16 which is operative for releasably securing the tip portion 14 on the handle portion 12.

Figure 3:
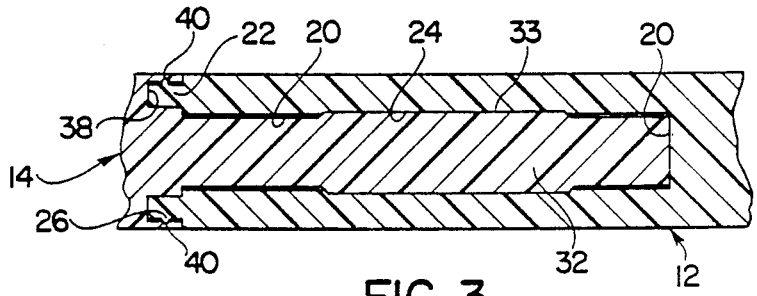
FIG. 3 is an enlarged, sectional view taken along line 3—3 in FIG. 1.
Figure 4:
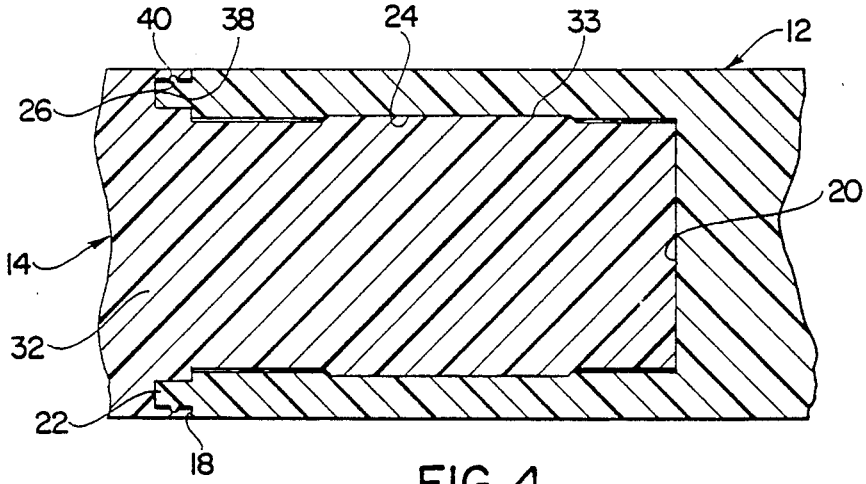
FIG. 4 is an enlarged, sectional view taken along the line 4—4 in FIG. 1.

The handle portion 12 is of elongated configuration and it is preferably of substantially the same overall shape as the handle portion of a conventional toothbrush. The handle portion 12 includes a brushing end 18 having a cavity 20 formed therein which extends longitudinally inwardly from the brushing end 18. The cavity 20 is preferably of substantially rectangular configuration, and a substantially rectangular rim 22 extends longitudinally outwardly from the brushing end 18 around the perimeter of the cavity 20. An elongated, longitudinally extending, slightly recessed slot 24 is formed on each of the four sides of the interior of the cavity 20 as illustrated in FIGS. 3 and 4 and a transversely extending rib 26 is formed on each of the four sides of the rim 22 as illustrated in FIG. 2. Further, the rim 22 is formed so that it is slightly recessed inwardly from the adjacent portions of the outer surface of the handle portion 12, as illustrated in FIGS. 2 through 4.

The tip portion 14 comprises a base or body portion 28 which is integrally molded from a suitable plastic material, a plurality of bristles 30 which are embedded in the base 28, and a projection 32 which is preferably integrally molded with the base 28. The base 28 is preferably of elongated configuration and it has opposite first and second ends 34 and 36, respectively and the bristles 30 are preferably of conventional construction and made of a suitable synthetic material, such as nylon. The projection 32 extends integrally outwardly from the first end 34 in a longitudinal direction with respect to the base 28. As illustrated in FIGS. 2 through 4, the projection 32 is recessed inwardly from the adjacent portions of the outer surface of the base 28 and the base 28 is of substantially rectangular cross-sectional configuration. Further, the base 28 is adapted and dimensioned to be snugly received in the cavity 20 for securing the tip portion 14 on the brushing end 18 of the handle portion 12. As illustrated in FIGS. 3 and 4, a recessed channel 38 projects inwardly into the base 28 around the perimeter of the projection 32. The channel 38 is of substantially rectangular configuration and it is positioned and dimensioned for snugly receiving the rim 22 therein when the projection 32 is received in the cavity 20. Formed in the interior of the channel 38 are transversely extending recesses 40 which are adapted and positioned for receiving the ribs 26 therein when the rim 22 is received in the recessed channel 38.

The detent assembly 16 comprises the ribs 26 and 33 and the recessed slots 24 and 40 which cooperate to releasably retain the brush or tip portion 14 on the brushing end 18 of the handle portion 12. Specifically, when the projection 32 is inserted into the cavity 20, the ribs 33 are releasably receivable in engagement in the elongated recessed slots 24 as illustrated in FIGS. 3 and 4 and the ribs 26 are releasably receivable in the elongated transversely extending recessed slots 40 in the channel 38. When the ribs 26 and 33 are releasably received in the recessed slots 24 and 40, respectively, in this manner they cooperate for releasably securing the tip portion 14 on the handle portion 12 in a manner which permits the toothbrush 10 to be effectively manipulated for brushing the teeth of a user, but which nevertheless permits the tip portion 14 to be readily and easily disengaged from the handle portion 12. In this connection, because of the elongated rectangular configuration of the projection 32, the projection 32 is effectively receivable in the cavity 20 for firmly and positively securing the tip portion 14 to the handle portion 12. In addition, because of the manner in which the rim 22 is releasably receivable in the recessed channel 38, the rim 22 and the channel 38 are capable of effecting a seal around the projection 32 for restricting the entrance of saliva and/or food particles into the cavity 20. Hence, the rim 22 and the recessed channel 38 are operative for effectively minimizing the potential locations for bacteria growth in the interfitting structure between the handle portion 12 and the tip portion 14 when the toothbrush 10 is not in use.

Figure 5:
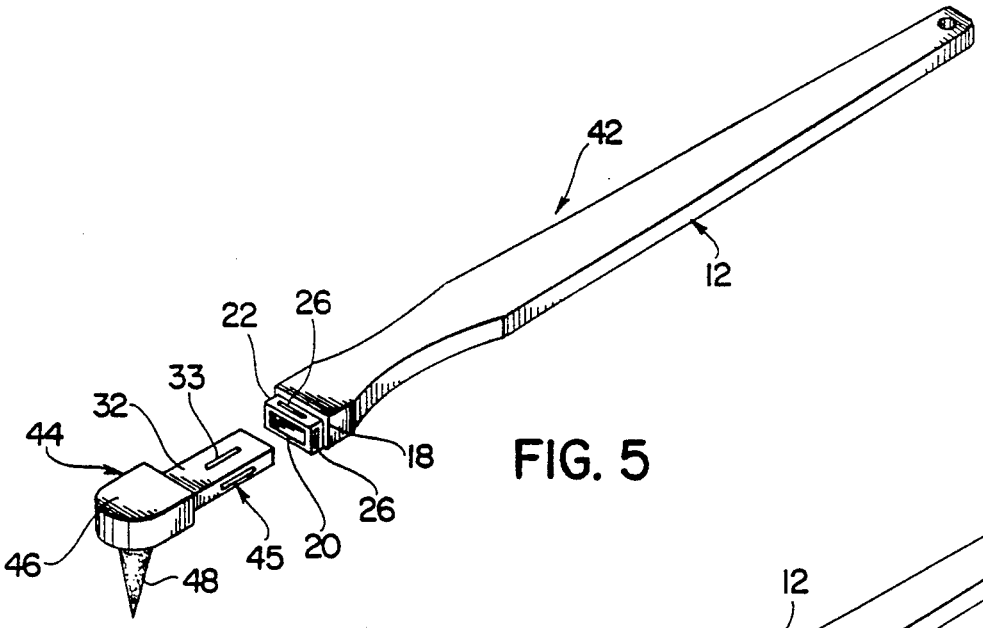
FIG. 5 is an exploded, perspective view of a second embodiment of the toothbrush of the instant invention.

Referring to FIG. 5, a second embodiment of the toothbrush of the instant invention is illustrated and generally indicated at 42. The toothbrush 42 includes a handle portion 12 which is substantially identical to the handle portion 12 of the toothbrush 10 and a tip portion 44. The tip portion 44 includes a base portion 46 which is integrally molded with a projection 32 and a rubber tip element 48 on the base portion 46. The base portion 46 is of reduced dimension as compared to the base portion 28, although it includes a recessed channel 38 (not shown) having a plurality of recessed slots 40 therein. The rubber tip element 48 is of conventional construction and it is preferably made from a suitable elastomeric material in a substantially conical configuration so that it can be effectively utilized for massaging the gums of a user. The toothbrush 42 is also adapted for use in a conventional manner and because the tip portion 44 is detachably secured to the handle portion 12, the tip portion 44 can be readily disengaged from the handle portion 12 and replaced with a new tip portion 44 or with a tip portion of a different configuration.

Figure 6:
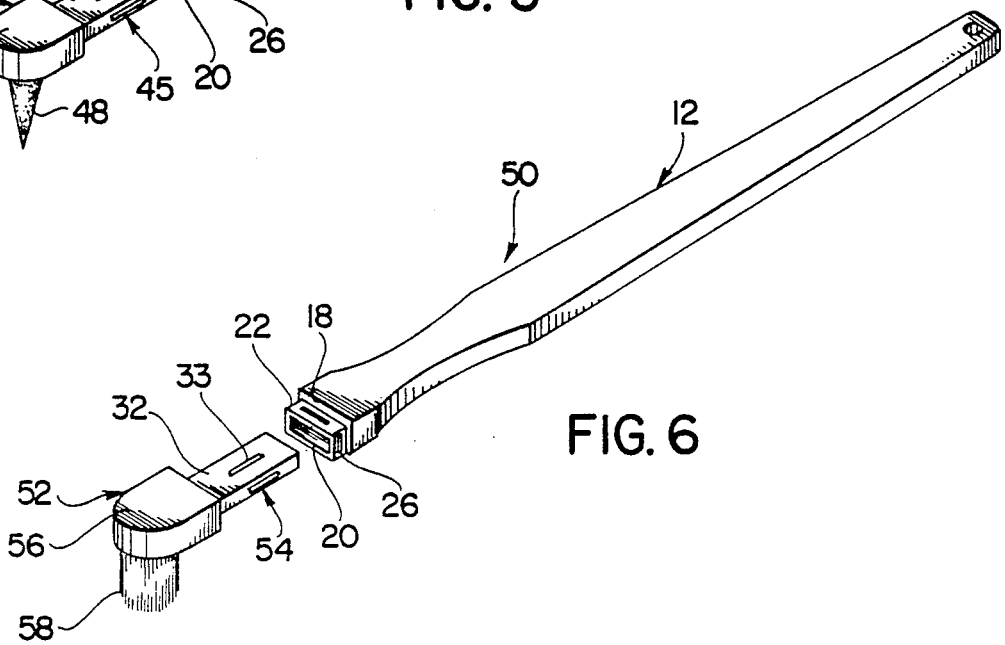
FIG. 6 is an exploded, perspective view of a third embodiment thereof.

Referring finally to FIG. 6, a third embodiment of the toothbrush of the instant invention is illustrated and generally indicated at 50. The toothbrush 50 comprises a handle portion 12, a tip portion generally indicated at 52 and a detent assembly generally indicated at 54. The handle portion 12 is substantially identical to the handle portions 12 of the brushes 10 and 42, and the tip portion 52 includes a base 56 having a plurality of bristles 58 thereon, and a projection 32. The base 56 is preferably integrally molded from a suitable plastic material in a reduced dimension as compared to the base 28, and the bristles 58, which are preferably made from a suitable material such as nylon, are preferably embedded in the base 56. The base 56 is preferably integrally molded with the projection 32, and a recessed channel 38 (not shown) having slots 40 therein, is formed in the base 56 around the perimeter of the projection 32. The tip portion 52 is adapted to the assembled with the handle portion 12 thereof in a manner similar to the way in which the tip portion 14 and the tip portion 44 are adapted to be assembled with their respective handle portions 12. However, the tip portion 52 is adapted for selectively brushing localized areas of a user's mouth so that it can be used after periodontal surgery.

It is seen therefore that the instant invention provides an effective toothbrush construction comprising a handle portion and a detachable tip portion. The toothbrushes 10, 42, and 50 can be effectively utilized for brushing the teeth or massaging the gums of a user. However, because the tip portions 14,44 and 52 are readily and easily detachable from their respective handle portions 12, the tip portions 14,44 and 52 can be readily interchanged for various specific applications, or they can be readily replaced when they become worn. Further, because the projections 32 are receivable in their respective cavities 20 and because the detent assemblies 16 are operative for securing the projections 32 in their respective cavities 20, the toothbrushes 10,42 and 50 can normally be effectively utilized as conventional toothbrushes or dental instruments. In addition, because of the manner in which the rims 22 are receivable in their respective channels 38 for sealing around their respective projections 32, the potential for bacteria growth in the structures utilized for connecting the handle portions 12 to their respective tip portions 14,44 or 52 are minimized. Accordingly, for these reasons it is seen that the toothbrushes 10, 42 and 50 represent significant advances in the art relating to dental hygiene products and that they therefore have significant commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A toothbrush comprising an elongated handle portion having a brushing end and a tip portion detachably received on said brushing end, said handle portion having a cavity therein which extends longitudinally inwardly from said brushing end, said cavity having a non-circular cross section, said tip portion including a base having an end, dental instrument means on said base for treating the teeth of a user and a projection extending outwardly from the end of said base, said projection being of non-circular cross section and being adapted to be snugly received in said cavity the end of said base also having a recessed channel formed therein, said channel extending completely around the perimeter of said projection on said end of said base, said handle portion having a rim on the brushing end thereof, said rim extending longitudinally outwardly around the perimeter of said cavity, said rim being of substantially the same dimension and configuration as said recessed channel and being releasably received therein to effect a seal between said handle portion and said tip portion around said projection in order to minimize the penetration of moisture into said cavity and means for releasably retaining said projection in said cavity to secure said tip portion on the brushing end of said handle portion.

2. In the toothbrush of claim 1 said cavity and said projection being of substantially the same dimension and configuration.

3. In the toothbrush of claim 2, said cavity and said projection being of substantially rectangular cross section.

4. In the toothbrush of claim 3, said retaining means further characterized as detent means releasably retaining said projection in said cavity.

5. In the toothbrush of claim 1, said handle portion having an outer surface, said rim being recessed inwardly from said outer surface.

6. In the toothbrush of claim 1, said cavity and said projection being of substantially rectangular cross section, said rim and said recessed channel being substantially rectangular.

7. In the toothbrush of claim 1, said dental instrument means further characterized as brush means for brushing the teeth of a user.

8. A toothbrush comprising an elongated handle portion having a brushing end and a tip portion detachably received on said brushing end, one of either the brushing end of said handle portion or said tip portion having a longitudinally inwardly extending cavity formed therein, the other of either the brushing end of said handle portion or said tip portion having a longitudinally extending projection formed thereon, said projection and said cavity being of non-circular cross section, said projection being snugly received in said cavity and means for releasably retaining said projection in said cavity in order to releasably secure said tip portion on said handle in end-to-end relation therewith, the one of either the brushing end of said handle portion or said tip portion having said projection thereon also having a recessed channel formed therein, said channel extending completely around the perimeter of said projection, the one of either the brushing end of said handle or said tip portion having said cavity formed therein having a rim thereon, said rim extending longitudinally outwardly around the perimeter of said cavity, said rim being of substantially the same dimension and configuration as said recessed channel and being releasably received therein to effect a seal between said handle portion and said tip portion around said projection in order to minimize the penetration of moisture into said cavity.

9. In the toothbrush of claim 8, the one of either the brushing end of said handle portion or said tip portion having said cavity formed therein having an outer surface, said rim being recessed inwardly from said outer surface.

10. In the toothbrush of claim 8, said cavity and said projection being of substantially rectangular cross section, said rim and said recessed channel being substantially rectangular.

11. In the toothbrush of claim 8, said dental instrument means further characterized as brush means for brushing the teeth of a user.

* * * * *